US005649588A

United States Patent [19]

Lee

[11] Patent Number: 5,649,588

[45] Date of Patent: Jul. 22, 1997

[54] CONDENSER FOR USE IN AUTOMOTIVE VEHICLES

[75] Inventor: In-Jun Lee, Taegu, Rep. of Korea

[73] Assignee: Dae Woo Automotive Components, Ltd., Rep. of Korea

[21] Appl. No.: 510,854

[22] Filed: Aug. 3, 1995

[51] Int. Cl.[6] ..... F28F 9/00

[52] U.S. Cl. ..... 165/67; 165/153; 165/173; 165/175; 29/890.052

[58] Field of Search ..... 165/67, 153, 173, 165/175; 29/890.052

[56] References Cited

U.S. PATENT DOCUMENTS 4,825,941 5/1989 Hoshino et al. ..... 165/153 X
5,172,762 12/1992 Shinmura et al. ..... 165/173

*Primary Examiner*—Leonard R. Leo

*Attorney, Agent, or Firm*—Laff, Whitesel, Conte & Saret, Ltd.

[57] ABSTRACT

The invention is a condenser for mounting in an automotive vehicle. The condenser has two headers which begin as flat sheets of metal that are formed into tubes with face-to-face flanges projecting somewhat radially and along the length of the header. At opposite sides of the flat sheets of metal two flanges are welded together in order to provide integral mounting brackets for the condenser. Fluid carrying tubes and separator plates are fitted into holes and slits, respectively, in the two metal plates in order to assemble the condenser. All parts are clad with a material having a low melting temperature so that all parts of the assembly may be welded together by placing it in an oven having a temperature which melts the cladding. The advantages of the invention are that the assembly is carried out on the outside of the header tube and no separate mounting brackets are necessarily required.

10 Claims, 2 Drawing Sheets

CONDENSER FOR USE IN AUTOMOTIVE VEHICLES

This invention relates to condenser type of assemblies for use in automotive vehicles and more particularly to such assemblies having built-in brackets for mounting them in the vehicle.

Reference may be made to my co-pending application Ser. No. 08/297,508, filed Aug. 29, 1994 for more information on this type of structure and for background to U.S. Pat. Nos. 4,945,635; 5,125,454; 5,152,339; 5,236,044; 5,307,870; and 5,329,995.

Automotive vehicles use the inventive type of assembly for several purposes such as a radiator for cooling the engine and a condenser for an air conditioning coolant. Among the recent improvements are the use of circular or semi-circular headers as part of the condensed assemblies such as that shown in my co-pending application. These assemblies present problems when the time comes for attaching them in the vehicle body because they do not have built-in mounting brackets. In the past, the problems have been solved by adding separate mounting brackets, but it was difficult to fix them to the header. The prior art has resorted to various flanges and extruded shapes to solve these problems, but they were costly, they made assembly difficult, and they were not always as successful as they could be.

Also, the circular or semi-circular header requires an installation of interior spaced parallel solid plates which divide the header tube into watertight sections or rooms thereby establishing flow paths through associated tubes extending between two spaced headers. It has been difficult to assemble and fix these separators in a manner which prevented the flow path from leaking.

In addition, the assembly of header shells, solid separator plates, and a plurality of flow tubes was difficult. There were problems of welds leaking, primarily because of the difficult assembly problems.

Accordingly, an object of this invention is to provide a simpler assembly procedure which leads to a better assembly that is less likely to encounter leakage problems.

In keeping with an aspect of the invention, these and other objects of the invention are provided by beginning with a flat sheet or piece of metal which is then rolled to form a tube. Opposite sides of the sheet come together to form a flange projecting radially from the tubes and along the length thereof. A number of slits or holes are preformed in the flat sheet of metal to receive the dividers and tubes which may be installed from the outside of the header, with suitable crimping performed after assembly. All of the parts are clad in a relatively low temperature melting material so that the complete assembly may be fused together in a suitable oven.

A preferred embodiment of the invention is shown in the attached drawings, in which.

Figure 1:
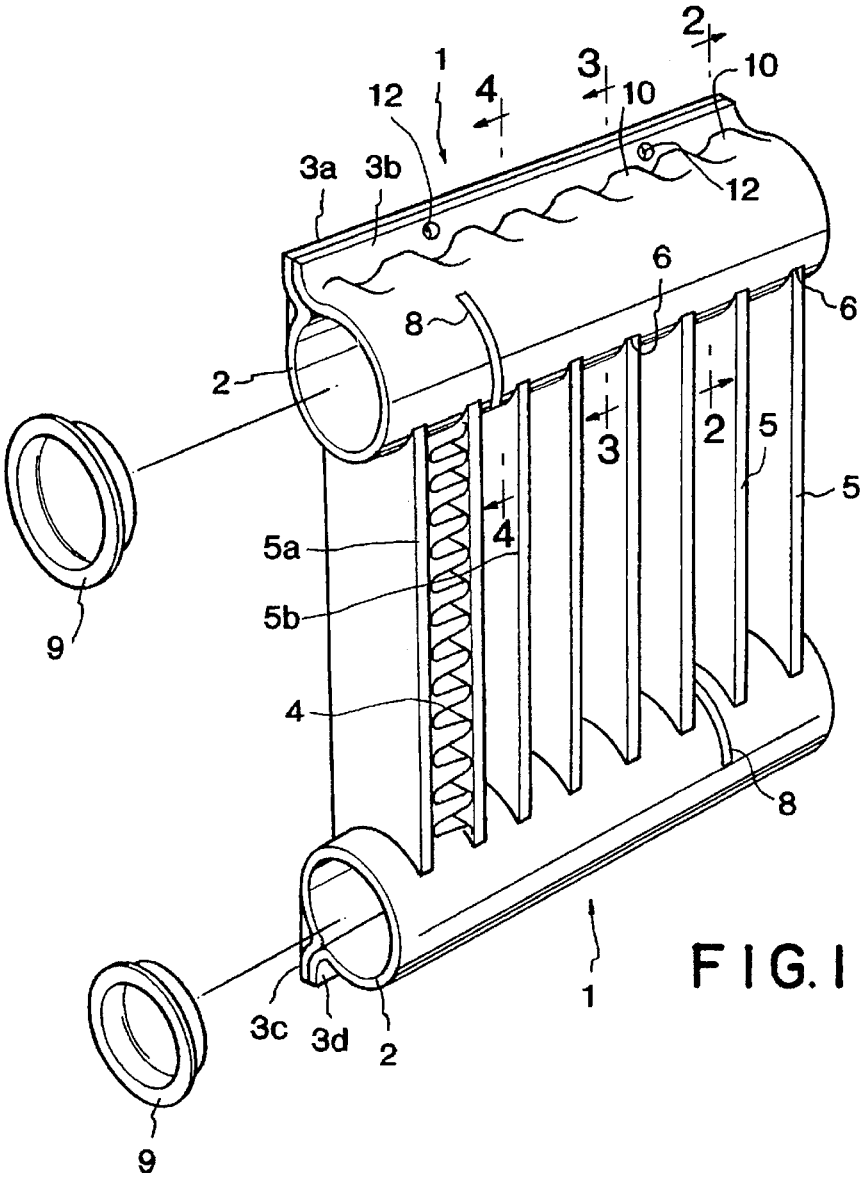
FIG. 1 is a perspective view which shows a completed inventive assembly.

In FIG. 1, the condenser assembly 1 has two spaced parallel circular headers 2 which have a number of fluid carrying tubes 5 extending between them. A suitable thin sheet of heat conductive material, bent into a corrugated sheet 4, fills each of the spaces between adjacent ones of the fluid carrying tubes 5. The entire assembly dissipates heat from a fluid which passes through the headers and tubes 5.

The circular header 2 begins as a flat sheet of metal pierced by openings to receive the fluid tubes 5 and a slit 8 to receive a dividing separator plate. Then the metal is formed into a tube of a suitable cross-sectional shape, here a circular cross-section. The two side edges of the sheet of metal come together in a face-to-face confrontation as two flanges 3, 3' which are welded together to extend somewhat radially from the header and along the length thereof. Along the length of the header, the weld between flanges 3, 3' forms a leak-proof seam. The resulting flange is used as a bracket to mount the condenser in an automotive vehicle.

Figure 2:
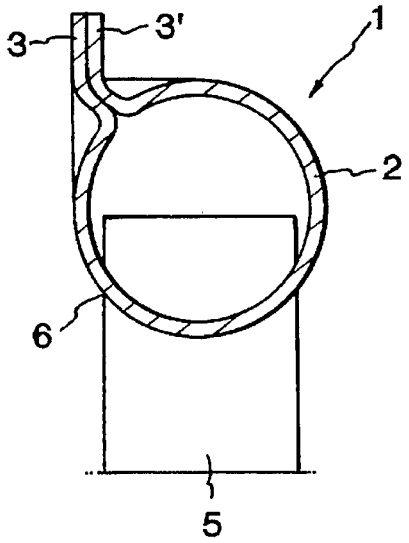
FIG. 2 is a cross-section taken along line 2—2 of FIG. 1, which shows a circular header and part of a tube for conveying water or another fluid between the two headers.
Figure 3:
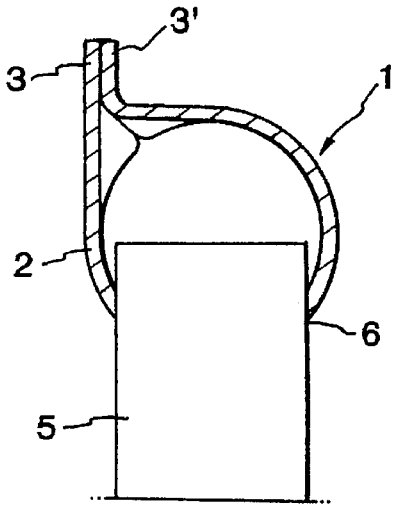
FIG. 3 is a similar cross-section view taken along line 3—3 of FIG. 1 showing an indention in the header and a separator plate in place behind a fluid carrying tube.

The plurality of fluid carrying tubes 5 are fitted into the openings 6 formed in each of the headers, in the manner shown in FIGS. 2 and 3. Each fluid tube 5 has openings on the opposite ends so that there is communication from one header 2 on one side through the tubes 5 to the other header 2 on the opposite side of the condenser.

Figure 1A:
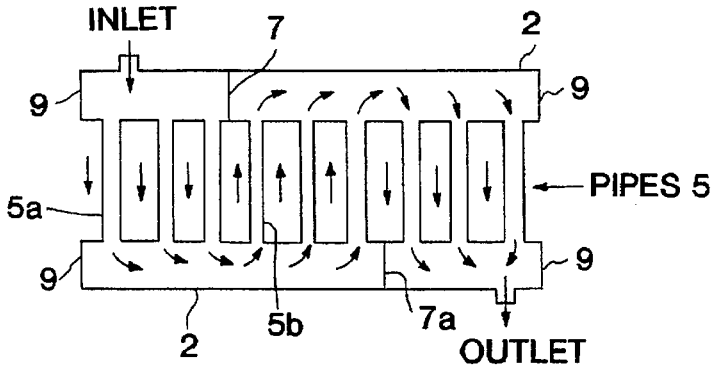
FIG. 1A shows the fluid flow path through the condenser of FIG. 1.
Figure 4:
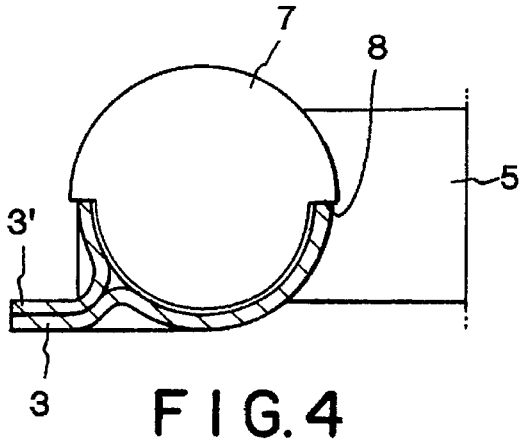
FIG. 4 is a cross-section view taken along line 4—4 of FIG. 1 and showing the separator plate.

Then, the flat separator plates 7 are inserted into slits 8 which are formed periodically along the length of the header. As best seen in FIG. 4, the separator plates 7 completely fill the interior of the header tube. Thus, as shown in FIG. 1A, the fluid may pass from the upper header 2, down tubes 5*a* and into a room or compartment sealed by a separator plate 7*a* in slit 8. The fluid departs from this sealed room or compartment via pipes 5*b*. In like manner, any suitable number of separator plates (here two), form partitions which make sealed rooms or compartments in the headers in order to couple all of the tubes into pairs of tubes for fluid to flow into and out of the rooms, thus conveying the fluid from an inlet to an outlet of the condenser. While FIG. 1A shows the inlet and outlet on opposite sides of the condenser, they could be on the same side of the condenser or at suitable ends of the headers.

At least one side of each of the two headers 2, 2 is formed into a corrugated series of ridges 10, 10 and valleys or depressions 11 in order to provide mechanical reinforcing. Preferably, this reinforcing is opposite the side of the header tubing which receives the fluid carrying tubes 5 and the slits 8 that receive the separator plates 7, although the reinforcing corrugations may be located at any given place on the header to accommodate the specific needs of any given structure. Since the tubes 5 and separator plates 7 are welded in place, they also add mechanical strength to the header.

As shown in FIG. 1, the corrugations 10, 11 also strengthen and support the confronting flanges 3, 3' formed by the sides of the metal plate that is rolled into the shape of a circular pipe 2. Therefore, the opposed flanges 3*a*, 3'*b* and 3*c*, 3'*d* form sturdy mounting brackets which may be used to attach the condenser to a vehicle, as at mounting holes 12, 12, for example.

The assembly is completed when four end cups 9 are attached to opposite ends of each of the two headers. Any suitable openings may be provided for giving fluid entrance to and exit from the assembly. For example, two end caps 9 may contain suitable couplers for receiving radiator hoses, or the like, as suggested in FIG. 1A.

All of the metal parts in FIG. 1 are coated on two sides by a cladding of material which melts at a temperature that is lower than the temperature at which the base metal melts. Therefore, after the assembly is completed, it is placed in an oven which melts the cladding material to a degree sufficiently to form a rigid and unified structure with all junctions between parts sealed by molten metal in a leak-proof manner. As the cladding material melts, the separators 7 and slits 8 help the welding flux to flow into each of the welds. After the tubes 5 and separators 7 are welded into place, they act as supporting struts which greatly strengthen the headers 2.

The advantages of the invention should now be clear. All of the parts are inserted from the outside of the headers 2, 2 which makes it easy to assemble the structure. In the prior art, the parts were, in effect, put into a box (half of header) and then the lid (the other half of the header) was put on the box. This meant that any misaligned tubes or separator plates made it difficult to get the lid on the box. The resulting sometimes poorly aligned parts often led to leakage. Also, the flanges 3, 3' are welded together and are supported by ridges 10 and valleys 11 of the corrugations in order to form very strong mounting brackets. Since the two flanges 3, 3' are not only welded together, but also sealed by the melted cladding, any appropriate number of mounting holes 12 may be formed therein, without producing leakage.

Those who are skilled in the art will readily perceive how to modify the invention. Therefore, the appended claims are to be construed to cover all equivalent structures which fall within the true scope and spirit of the invention.

The claimed invention is:

1. A condenser comprising two spaced parallel headers with a plurality of fluid carrying tubes extending between and communicating into interiors of said headers, said headers being formed by a sheet of metal rolled into a tube and having flanges on opposite sides thereof, said flanges extending tangentially from said rolled sheet metal tube, said flanges being secured and sealed together in a face-to-face confrontation and in a leak-proof manner, each of said sheets of metal forming said headers having openings for receiving opposite open ends of tubes giving communication between said two headers, slits formed in said headers without cutting into said opposite sides of said rolled sheet metal, said slits separating said fluid carrying tubes into pairs of tubes, and separator plates inserted from outside said header and fitting through said slits and sealing interior compartment spaces within said headers to form leak-proof rooms therein whereby said condenser may be assembled from outside said header, one of the pair of fluid carrying tubes in each of said pairs conveys fluid into a leak-proof room and the other tubes in each of said pairs of fluid carrying tubes conveys said fluid out of said leak-proof room.

2. A condenser comprising two spaced parallel headers with a plurality of fluid carrying tubes extending between and communicating into interiors of the headers, said headers being formed by a sheet of metal rolled into a tube and having flanges on opposite sides thereof, said flanges being secured and sealed together in a face-to-face confrontation and in a leak-proof manner, each of said sheets of metal forming said headers having openings for receiving opposite open ends of tubes giving communication between said two headers, slits in said headers for separating said fluid carrying tubes into at least pairs of tubes, separator plates inserted from outside said header and fitting through said slits and sealing interior compartment spaces within said headers to form leak-proof rooms therein whereby said condenser may be assembled from outside said header, one of the pair of fluid carrying tubes in each of said pairs conveying fluid into a leak-proof room and the other tubes in each of said pairs of fluid carrying tubes conveying said fluid out of said leak-proof room, and corrugations formed on at least one side of said header for strengthening and supporting said flanges in order to form condenser mounting brackets integral with said header.

3. The condenser of claim 2 and a plurality of caps for sealing ends of said headers.

4. The condenser of claim 3 and a corrugated strip of heat conductive material filling spaces between said fluid carrying tubes to conduct heat away from any fluid inside said tubes.

5. The condenser of any of the claims 1–4 wherein each of said headers, said tubes, and said separator plates is clad in a material having a melting temperature which is lower than a melting temperature of said headers, said tubes, and said separator plates whereby all of said parts may be assembled and heated to at least said lower melting temperature for welding said parts together.

6. A method making a condenser comprising the steps of (a) piercing a pair of flat sheets of clad metal with holes for receiving ends of fluid carrying tubes and slits for receiving separator plates, said slits being located to divide said header with at least two of said holes being in leak-proof rooms defined by said separator plates, further said slits being located at places other than side edges of said flat sheets of clad metal;

(b) forming said sheets into tubular headers with opposite sides of said sheets being brought together into face-to-face flanges which meet and project somewhat tangentially from said tube and extend along the length of said header, said flanges forming mounting brackets for said condenser;

(c) placing clad separator plates in each of said slits for dividing said headers into said leak-proof compartments, each of said compartments containing said at least two of said holes for receiving said fluid carrying tubes;

(d) inserting opposite ends of clad fluid carrying tubes into corresponding holes in said two headers for holding said two headers in a spaced relationship, said fluid carrying tubes having open ends to provide communication for fluid to flow back and forth between said headers;

(e) said cladding being a material having a melting temperature which is lower than a melting temperature of said header, tubes, and separation plates; and (f) heating an assembly of said headers, tubes, and separator plates to a temperature at least equal to said lower melting temperature, whereby said assembly is assembled from outside said header and is then welded together.

7. A method of making a condenser comprising the steps of (a) piercing a pair of flat sheets of clad metal with holes for receiving ends of fluid carrying tubes and slits for receiving separator plates, said slits being located to divide said header with at least two of said holes being in leak-proof rooms defined by said separator plates;

(b) forming said sheets into tubular headers with opposite sides of said sheets being brought together into face-to face flanges which meet and project somewhat radially from and along the length of said header, said flanges forming mounting brackets for said condenser, and the added step of corrugating said metal sheets at a location which strengthen and support said flanges;

(c) placing clad separator plates in each of said slits for dividing said headers into said leak-proof compartments, each of said compartments containing said at lease two of said holes for receiving said fluid carrying tubes;

(d) inserting opposite ends of clad fluid carrying tubes into corresponding holes in said two headers for holding said two headers in a spaced relationship, said fluid carrying tubes having open ends to provide communication for fluid to flow back and forth between said headers;

(e) said cladding being a material having a melting temperature which is lower than a melting temperature of said header, tubes, and separation plates; and (f) heating an assembly of said headers, tubes, and separator plates to a temperature at least equal to said lower melting temperature, whereby said assembly is assembled from outside said header and is then welded together.

8. The condenser of claim 7 and the added step of closing said tubular headers with end caps.

9. The condenser of claim 7 and the added step of filling spaces between said tubes with a heat dissipating corrugated metal.

10. The condenser of claim 7 wherein each of said at least two of said holes is a plurality of said holes.

* * * * *